US006003578A

United States Patent [19]

Chang

[11] Patent Number: 6,003,578

[45] Date of Patent: Dec. 21, 1999

[54] PORTABLE ELECTRICAL WRAPPING APPARATUS

[76] Inventor: Jeff Chieh Huang Chang, No. 34-3, Lane 101, 38th Rd., Taichung Industrial Park, Taichung, Taiwan

[21] Appl. No.: 09/071,882

[22] Filed: May 4, 1998

[51] Int. Cl.[6] ..... B65B 13/32

[52] U.S. Cl. ..... 156/494; 156/73.5; 156/510; 156/580; 100/32; 100/33 PB

[58] Field of Search ..... 156/73.5, 157, 156/159, 494, 502, 507, 580, 229, 510; 100/29, 32, 33 PB

[56] References Cited

U.S. PATENT DOCUMENTS

| | | | |
|---|---|---|---|
| 4,050,372 | 9/1977 | Kobiella | 156/73.5 X |
| 4,313,779 | 2/1982 | Nix | 156/361 |
| 4,820,363 | 4/1989 | Fischer | 156/494 |
| 4,934,261 | 6/1990 | Niedrig | 100/32 |
| 5,380,393 | 1/1995 | Grabarek et al. | 156/358 |
| 5,476,569 | 12/1995 | Haradda | 156/502 |
| 5,632,851 | 5/1997 | Young | 156/494 |
| 5,853,524 | 12/1998 | Nix | 156/358 |

*Primary Examiner*—James Sells
*Attorney, Agent, or Firm*—Rosenberg, Klein & Lee

[57] ABSTRACT

The present invention relates to a portable electric wrapping apparatus, comprising a motor to drive a main shaft, which moves a tensioning mechanism and a sealing and cutting unit. The tensioning mechanism and the sealing and cutting unit can be designed as individual modules and put together with the main body. The tensioning mechanism may be two frictional wheels each having cutting grooves or a single wheel aiming at the frictional plates to evenly apply pressure to the packaging tape therebetween and strain it for wrapping a package tightly. With the aid of a tension control rod, the tensioning mechanism can move the sealing and cutting unit downward to weld and cut the packaging tape automatically.

10 Claims, 16 Drawing Sheets

PORTABLE ELECTRICAL WRAPPING APPARATUS

BACKGROUND OF THE INVENTION

To efficiently pack articles to be delivered people typically use packaging tape having a certain width to wrap around cartons housing these articles. Conventional wrapping apparatuses are operated manually and use metal buckles to fasten two ends of a strap. Such an apparatus must be manipulated by manual and is quite convenient. In addition, metal buckles do not have a strong grip so that it may allow a strap slides out of places. Besides, metal buckles may injure human body and so it is desirable to have an improvement made on this matter.

Currently there are electric wrapping apparatuses in the market, which use a motor to drive a tensioning mechanism and a hot sealing unit to perform wrapping. However, a typical deficiency is that the channel through which packaging tape passes must be curved to prevent tape from retreat during hot melting. Such a configuration results in poor tensioning. Moreover, frictional wheels are driven directly by a motor shaft and so it can not reach a high reduction ratio. Such a high rotation speed and quick rubbing will degrade the frictional wheels in a short time. Further, conventional apparatuses have an integrated construction and they can not be made as individual modules. Thus this design increases production costs and limits the application.

Accordingly, the object of the present invention is to provide an innovative portable electrical wrapping apparatus having an original construction that can quickly fold a strap around a package tightly.

Now the structural features and advantages of the invention will be described in detail with reference to the accompanying drawings.

BRIEF DESCRIPTION OF ACCOMPANYING DRAWINGS

DETAILED DESCRIPTION OF THE PREFERRED EMBODIMENTS

Figure 1:
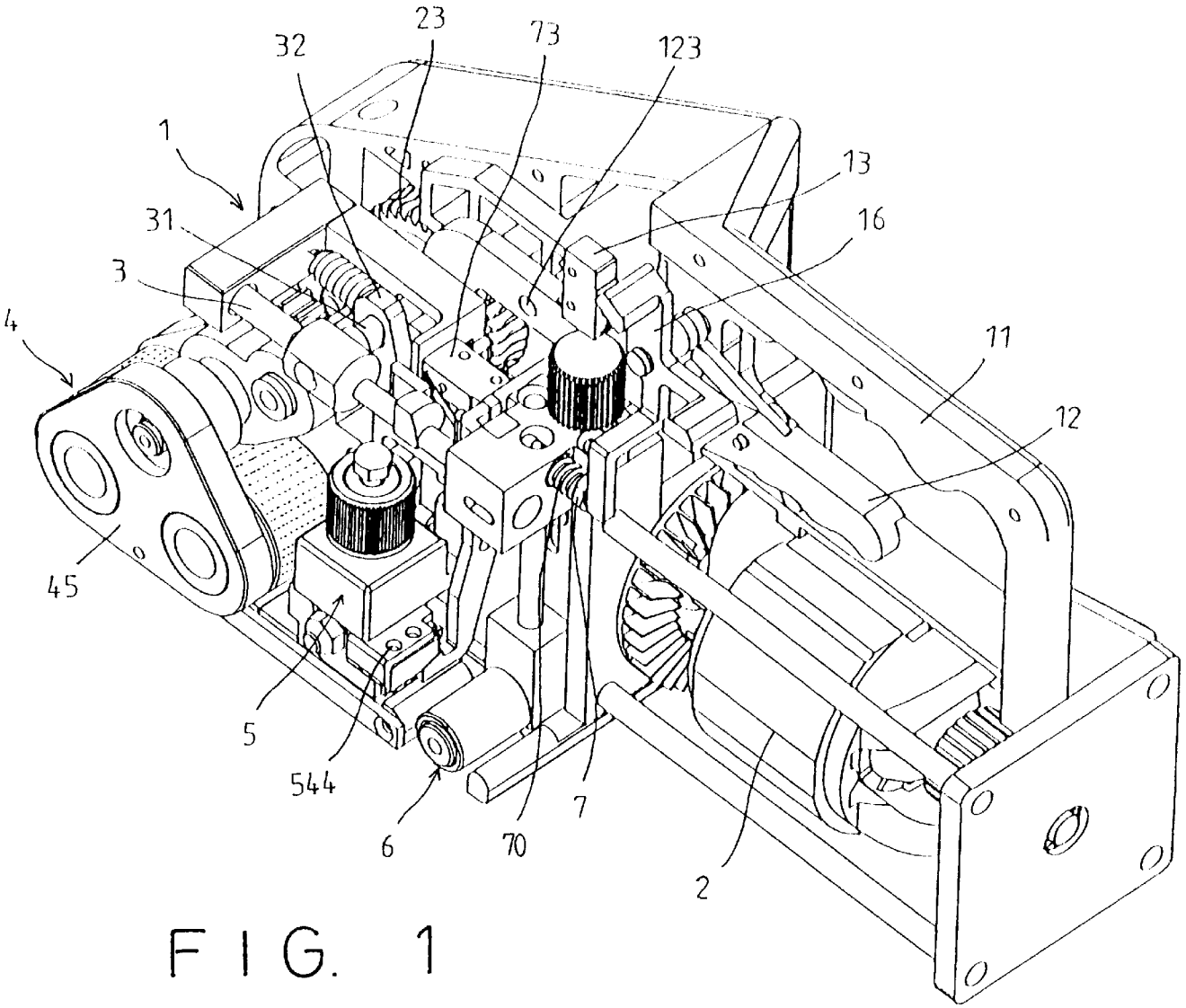
FIG. 1 is a perspective view schematically illustrating the entire structure of a portable electrical wrapping apparatus according to the invention.
Figure 2:
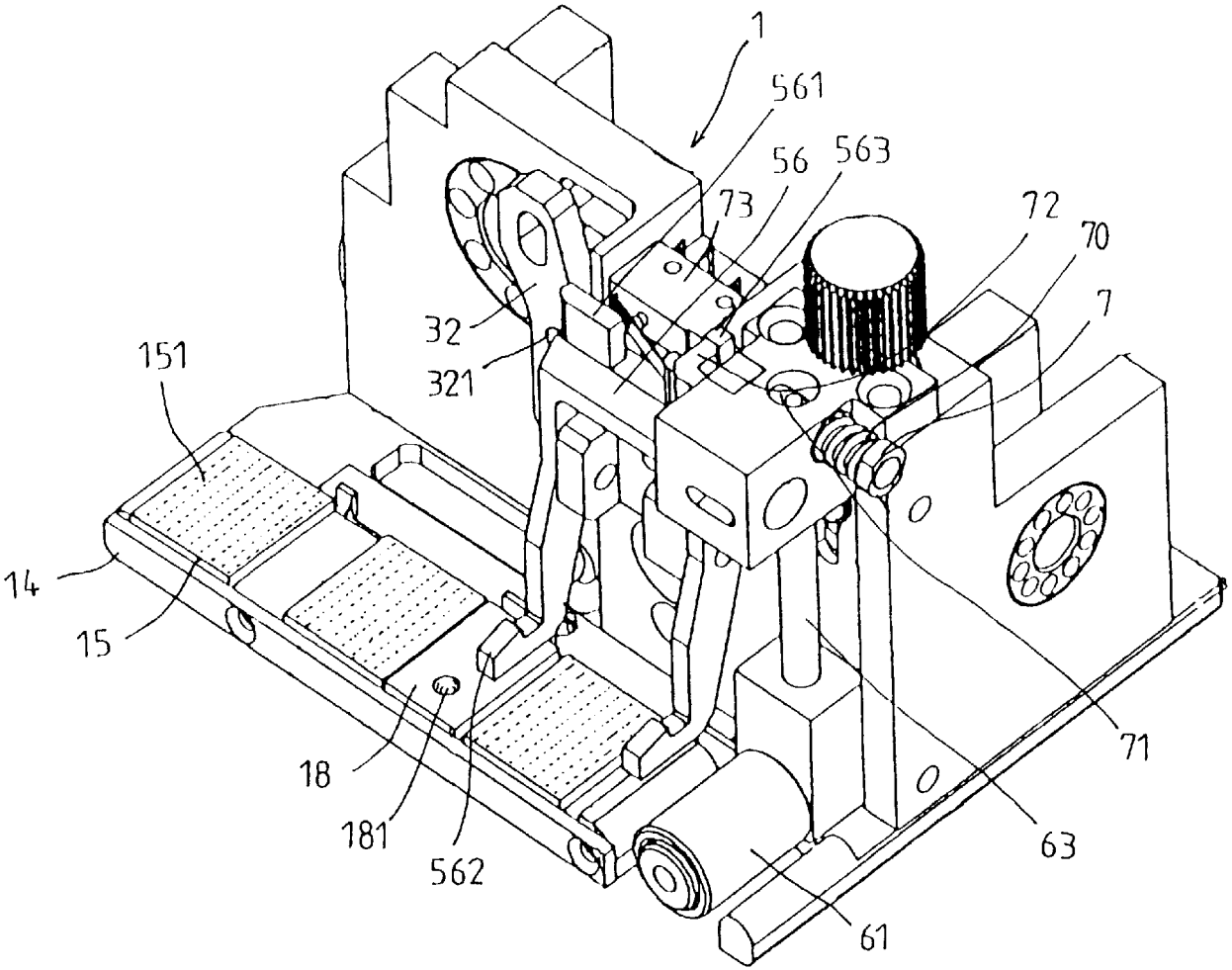
FIG. 2 depicts the structure of the main body of the invention.

Referring to FIGS. 1 through 5, the invention primarily includes a main body (1). The rear end of the main body (1) carries a motor (2) secured at a lower position. Above the motor (1) is a handle (11) and a lever (12) extending from the rear end of the main body (1). A transverse rod (3) is disposed above the main body (1). The lever (12) is pivotably attached by a pin (123) to the main body (1) and has a hook (121) at its lower end to grasp a pole (31) laterally extending from the transverse rod (3). A driven block (31) is pivotably disposed inside the main body (1), with the upper end mounted on the pole (31) and the lower end having a threaded hole (321). As shown in FIG. 2, the main body (1) can be made as a module and then combined with a tensioning mechanism (4) and a sealing and cutting unit (5) of FIGS. 3 and 4.

Figure 3:
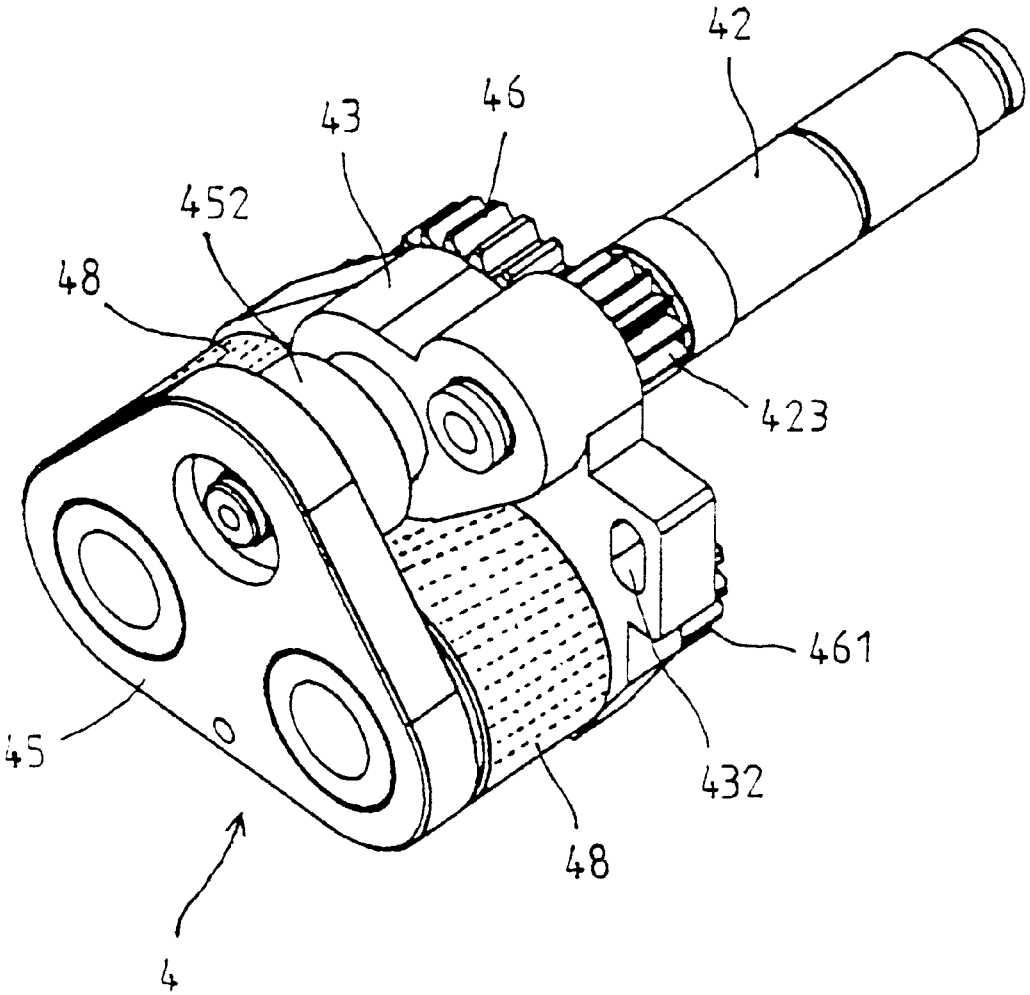
FIG. 3 shows the tensioning mechanism of the invention.
Figure 4:
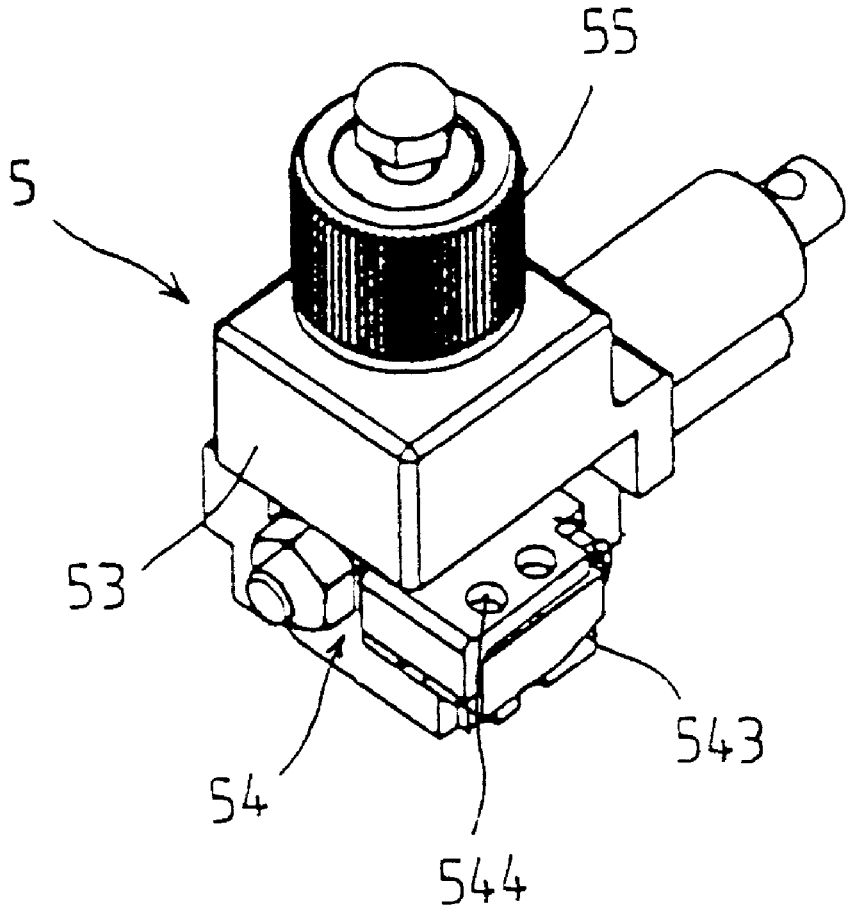
FIG. 4 is a schematic view indicating a sealing and cutting unit of the invention.
Figure 5:
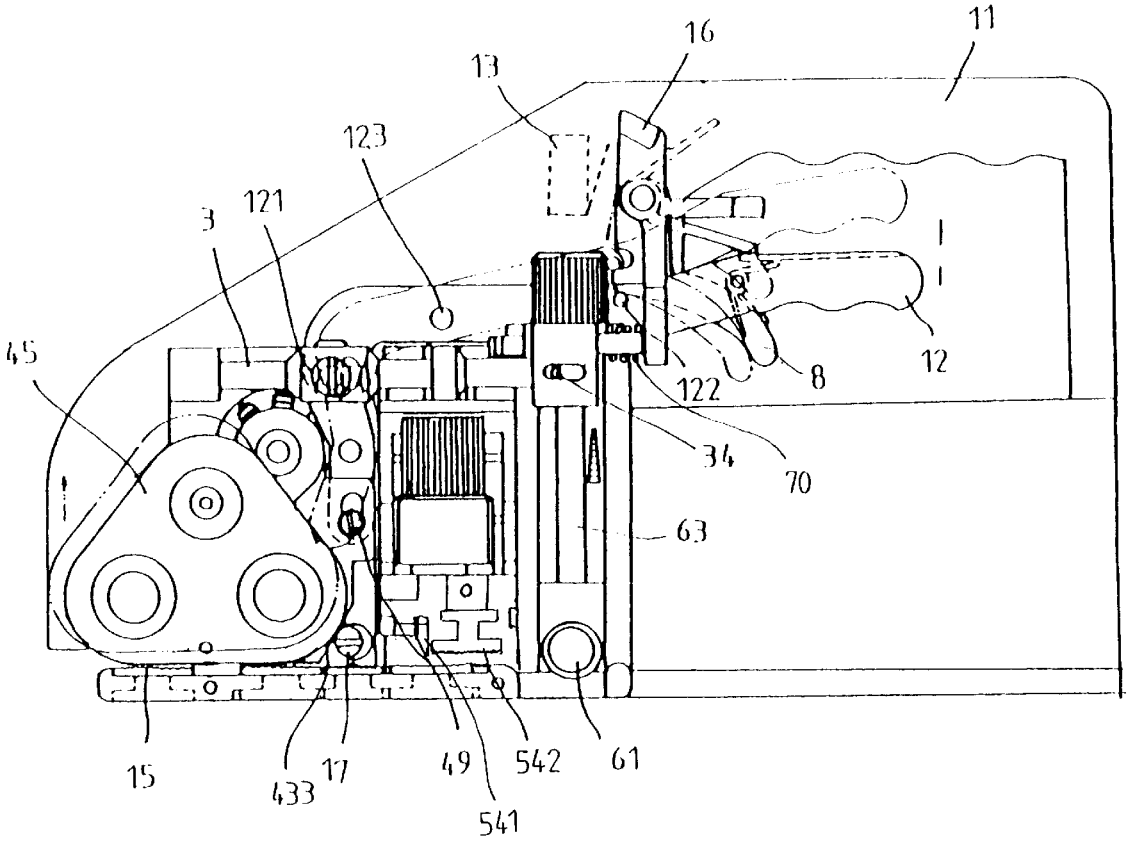
FIG. 5 is a cross-sectional view of the apparatus of FIG. 1 taken along a longitudinal direction.
Figure 6:
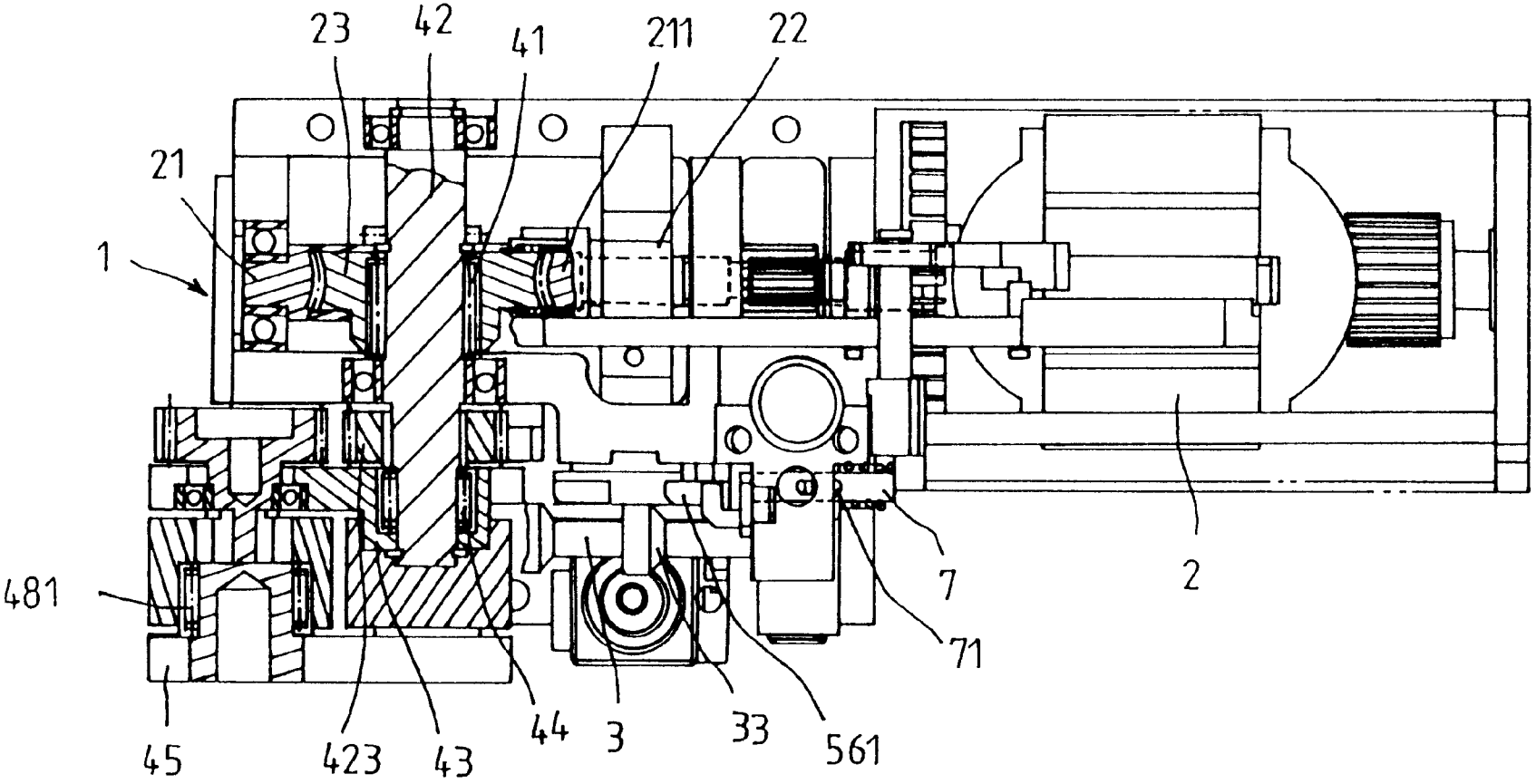
FIG. 6 is a cross-sectional view of the apparatus of FIG. 1 taken along a transverse direction.
Figure 7:
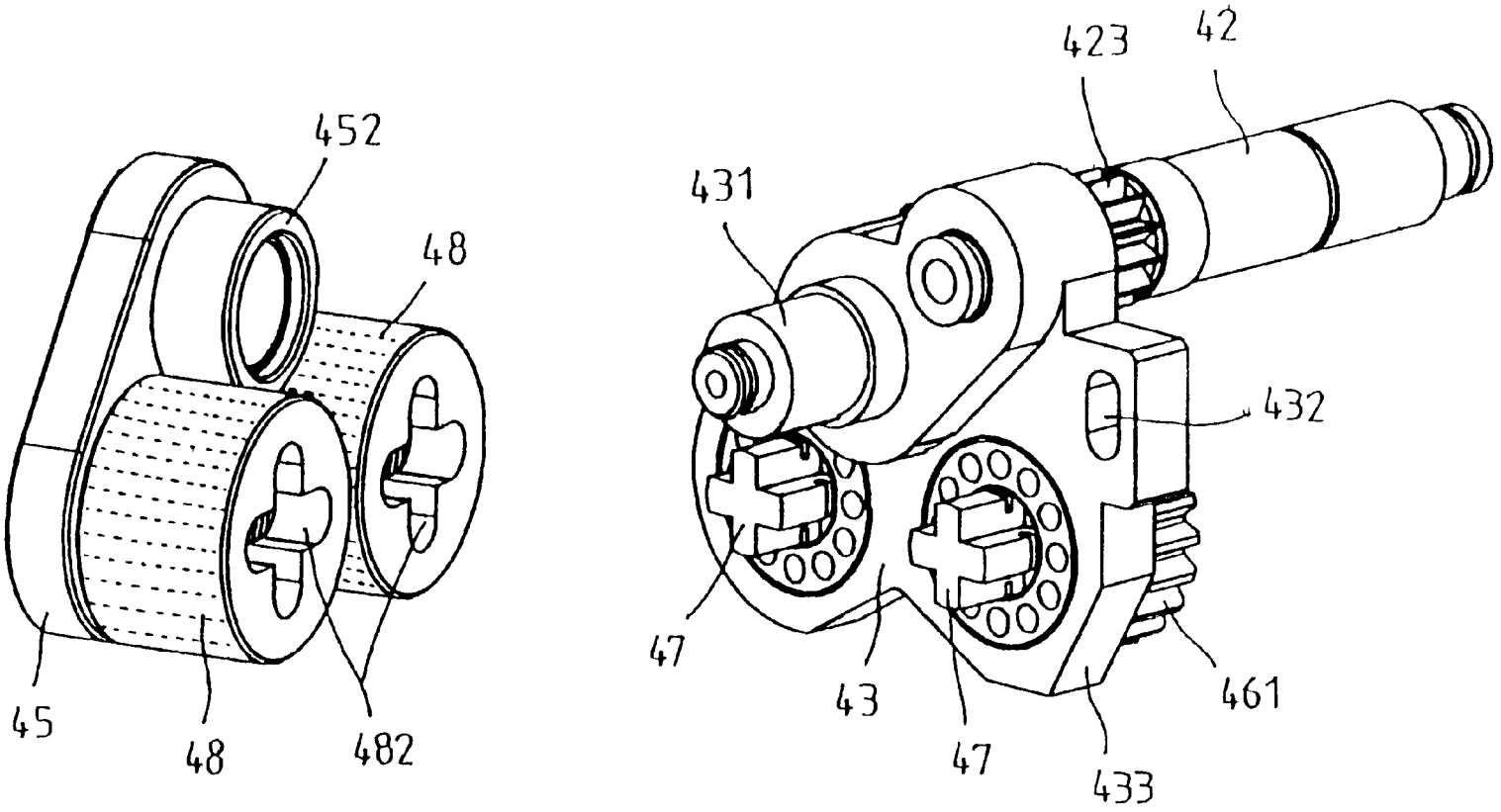
FIG. 7 is an exploded view of the tensioning mechanism of FIG. 3.
Figure 8:
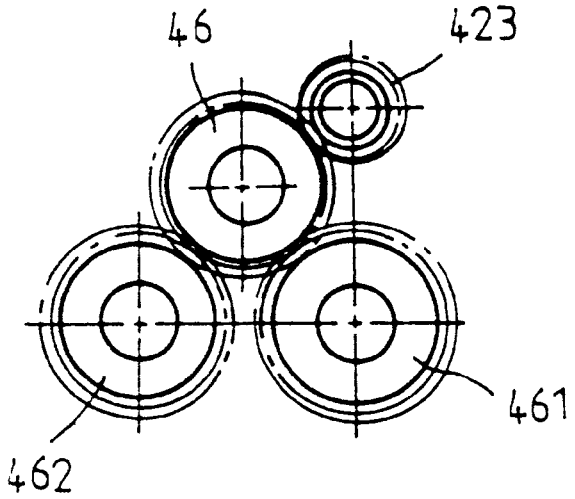
FIG. 8 is a schematic view showing a gear train of the invention.

The shaft of the motor (2) extends into the main body (1), as shown in FIGS. 5 through 7, to drives a main shaft (21). The main shaft (21) is provided at its outer end with a pinion (211) to drive a worm (23). The tensioning mechanism (4) has a transmission shaft (42), to which a worm (23) is connected through a unidirectional bearing (41). Hence, through the worm (23) the main shaft (21) drives the transmission shaft (42) in one direction only. The transmission shaft (42) is provided with a gear (423) at its rear segment and connected to an internal support plate (45) at its outer end through a bearing (44). The internal support plate (43) has on one side surface thereof a protrusive driving shaft (431), which extends into a hollow pole (452) of an external support plate (45) to support the external support plate (45). The internal support plate (43) has an elliptical hole (432), through which a threaded bolt (49) passes. The threaded bolt (49) engages on its end with a threaded hole (321) of a driving plate (32). The gear (423) engages with a gear train consisting of three gears (46, 461, 462) as shown in FIG. 8. Two gears (461, 462) occupying lower positions individually have a cross-shaped axle (47) projecting toward the external support plate (45). The external support plate (45) includes on the corresponding side two frictional wheels (48) with a cross-shaped groove (482) formed thereof. The groove (482) is dimensioned to receive a cross-shaped axle (47) with clearance fit, as shown in FIGS. 3 and 7.

Figure 9:
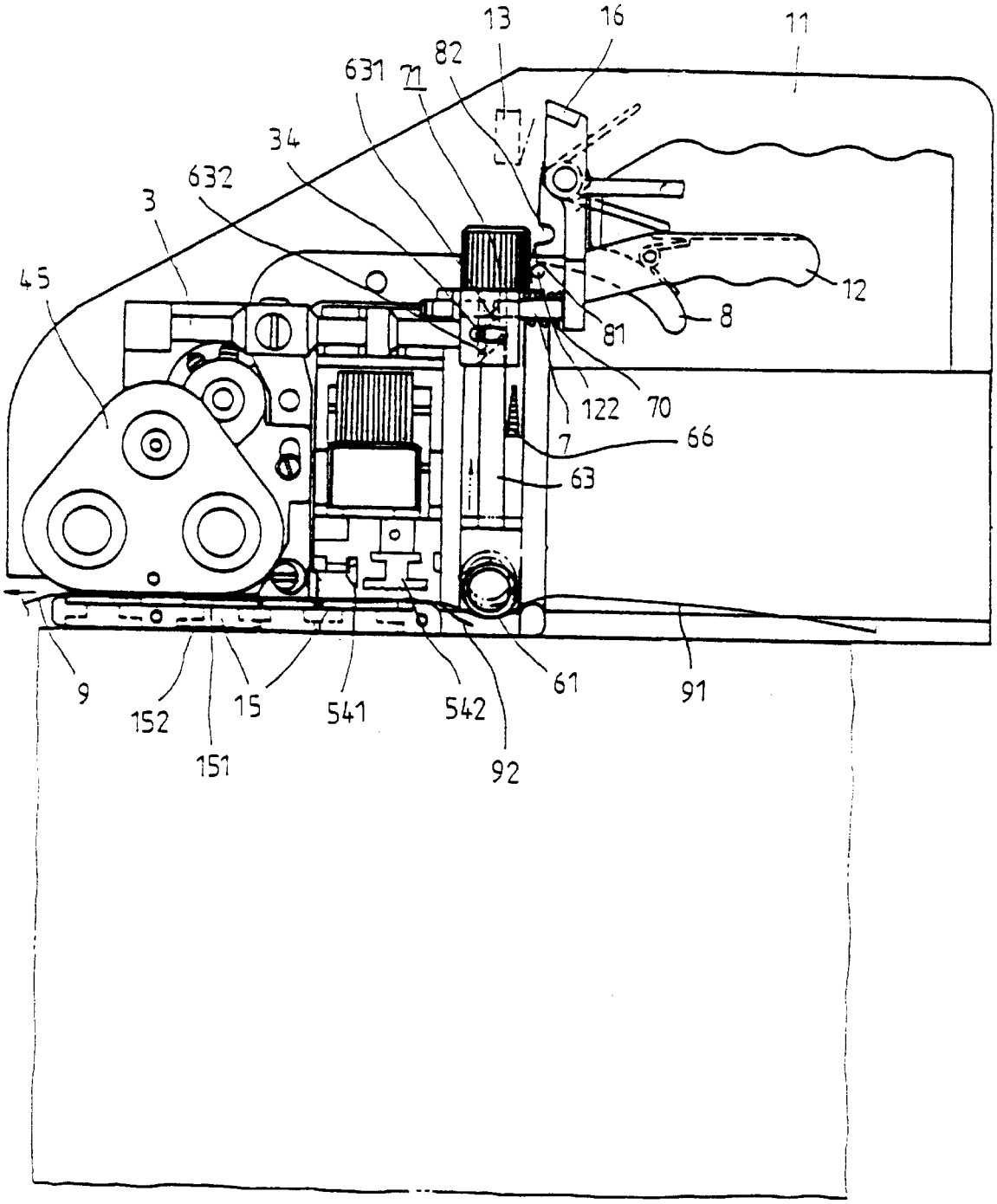
FIG. 9 illustrates the movement of the tensioner of the invention.

A unidirectional bearing (22), together with an eccentric wheel (51), mounts on the middle segment of the main shaft (21). Through the unidirectional bearing, the main shaft (21) drives a sealing and cutting unit (5) in one direction only as shown in FIG. 12. Outside the eccentric wheel (51) is a U-shaped connecting block (52) linked with a stationary block (53) on one end. A fusion block (54) is coupled with an adjustment wheel (55). The adjustment wheel (55) further engages with the stationary block (53) by screw threads. With reference to FIG. 9, a cutter (541) and an upper friction plate (542) are inserted into the lower portion of the fusion block (54). As can be seen from FIGS. 1, 2, and 11, a reversed U-shaped frame (56) pivotably mounts on the main body. Two raised blocks (561) on the top of the frame (56) locate near the transverse rod (3) having an oblique surface (33). Two hooks (562) configured to be caught by the inclined surface (543) of the fusion block (54) are respectively formed on two lower ends of the frame (56).

Figure 10:
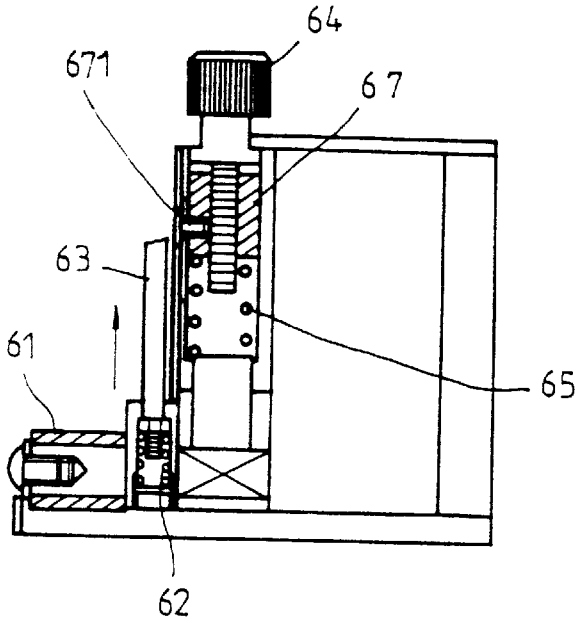
FIG. 10 is a partial cross sectional side view of the tensioner of figure 9.

A tensioner (6) is by the sealing and cutting unit (5) as shown in FIGS. 9 and 10. The tensioner (6) comprises a round column (61) as well as a spring (62) therein. The top of the spring (62) is connected to a push rod (63). The push rod (63) is equipped with an upper and a lower oblique surface (631, 632), the upper oblique surface (631) being located in a central slot (71) of a movable block (7) and the lower oblique surface (632) being situated below a guide pin (34) at the end of the transverse rod (3). Referring to FIG.

2, the movable block (7) has a crooked portion (72) formed on the end thereof and abutting against a lock plate (563) disposed above the U-shaped frame (56). Further, a contact switch (73) is provided between the main body and the U-shaped frame (56).

In operation, the lever (12) along with a lock plate (8) is first moved upward. The lock plate (8) is pivotably attached to the handle (11) and provided with a locking edge (81) and a lock groove (82) at the front. The locking edge (81) forces against a locking pin (122) located on one side of the lever (12). As the locking edge (81) of the lock plate (8) slides and disengages from the locking pin (122), the lever (12) starts to rise as shown in FIG. 5. In the mean time, the hook (121) on the other end of the lever (12) urges the transverse rod (3) and the driving plate (32). The driving plate (32) further moves the internal support plate (43) around the transmission shaft (42) and turns the external support plate by the driving shaft (431) and the bearing (44) to displace a certain angle to expose the space below to the outside. Then, the lock groove (82) engages with the locking pin (122) to hold the lock plate (8) so as to allow packaging tape (9) to get in.

Below the main body (1) is a base (14) on which frictional plates (15) are disposed at positions corresponding to two functional wheels (48) and an upper frictional plate (542). Each frictional plate (15) has frictional surfaces (151, 152) respectively on the top and the bottom side and they are replaceable if worn out. Disposed between the lower frictional plates is a locating block (18) with a spring steel ball (181) as shown in FIG. 2, with which the apparatus can be adapted for different sizes of packaging tape.

When packaging tape (9) wrapping around a package is placed in position, release the lever (12) and the lock plate (8). Then the above components will return to their original positions due to spring forces and two frictional wheels (48) under the external support plate (45) can evenly apply forces against the packaging tape (9). That is because two frictional wheels (48) and driving cross shaped axles (47) are driven by the rotational motion of the driving shaft (431) to produce a uniform output. After the extension portion (16) is pushed forward and the start switch (13) is depressed, the motor (2) begins rotating the main shaft (21) in a forward direction, which in turn brings the pinion (211) and the worm (23) driven as well as the unidirectional bearing (41) to rotate. After that, the transmission shaft (42) starts to rotate. (If the main shaft (21) rotates in a reversed direction, the transmission shaft (42) can not be driven). Hence the transmission shaft (42) brings the gears (46, 461, 462) driven by the transmission shaft (42) also begin rotating. Gears (461, 462) rotate the two frictional wheels (48) through cross-shaped axles (47). As a result, the packaging tape (91) on the frictional wheels moves to the left to strain the tape gradually to a preset tightness.

Figure 11:
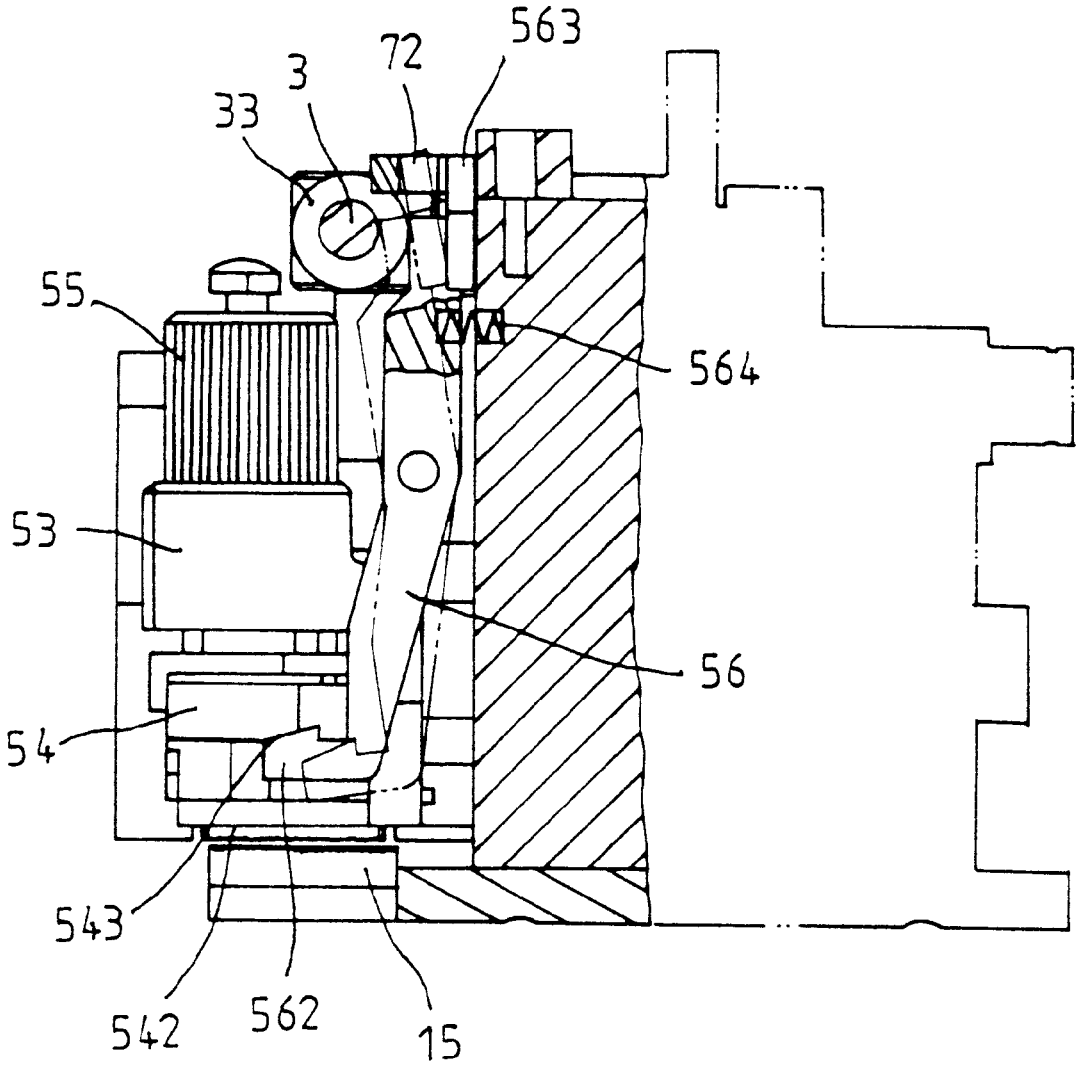
FIGS. 11 through 13 illustrate the movement of the sealing and cutting unit of the invention.
Figure 12:
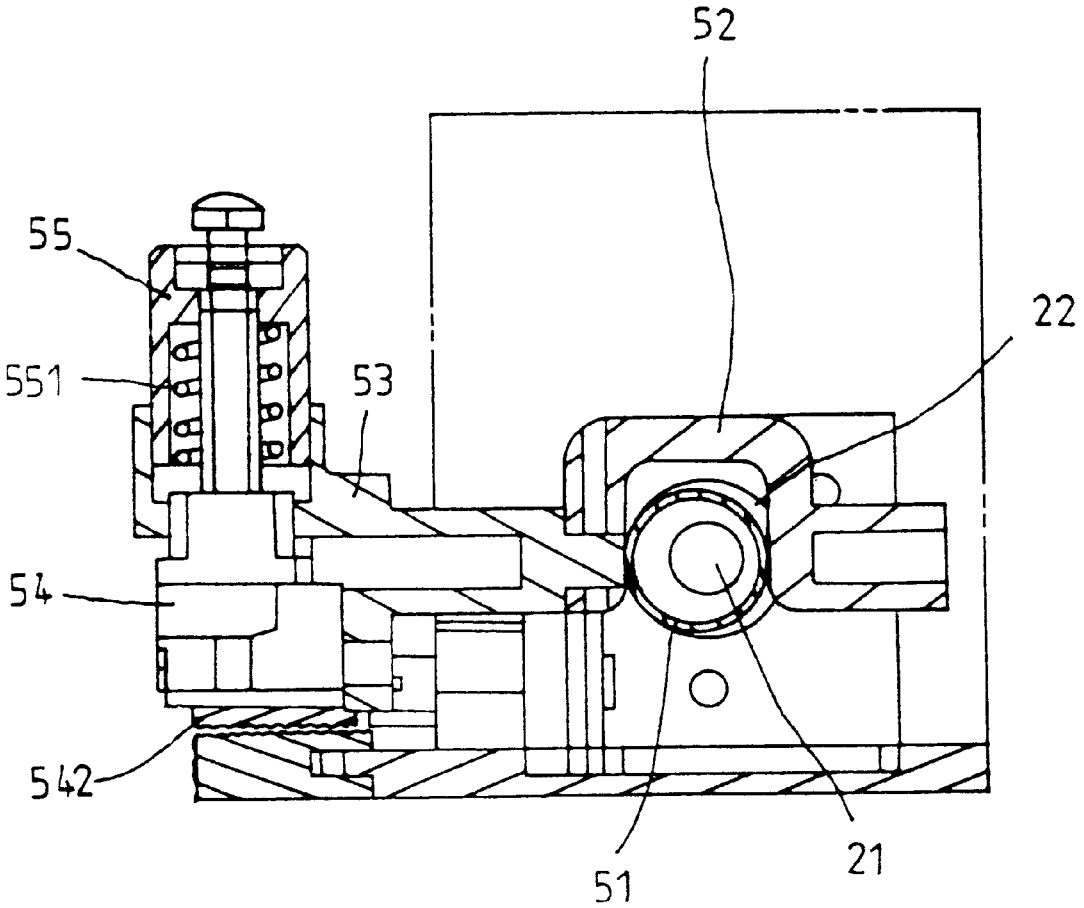
Figure 13:
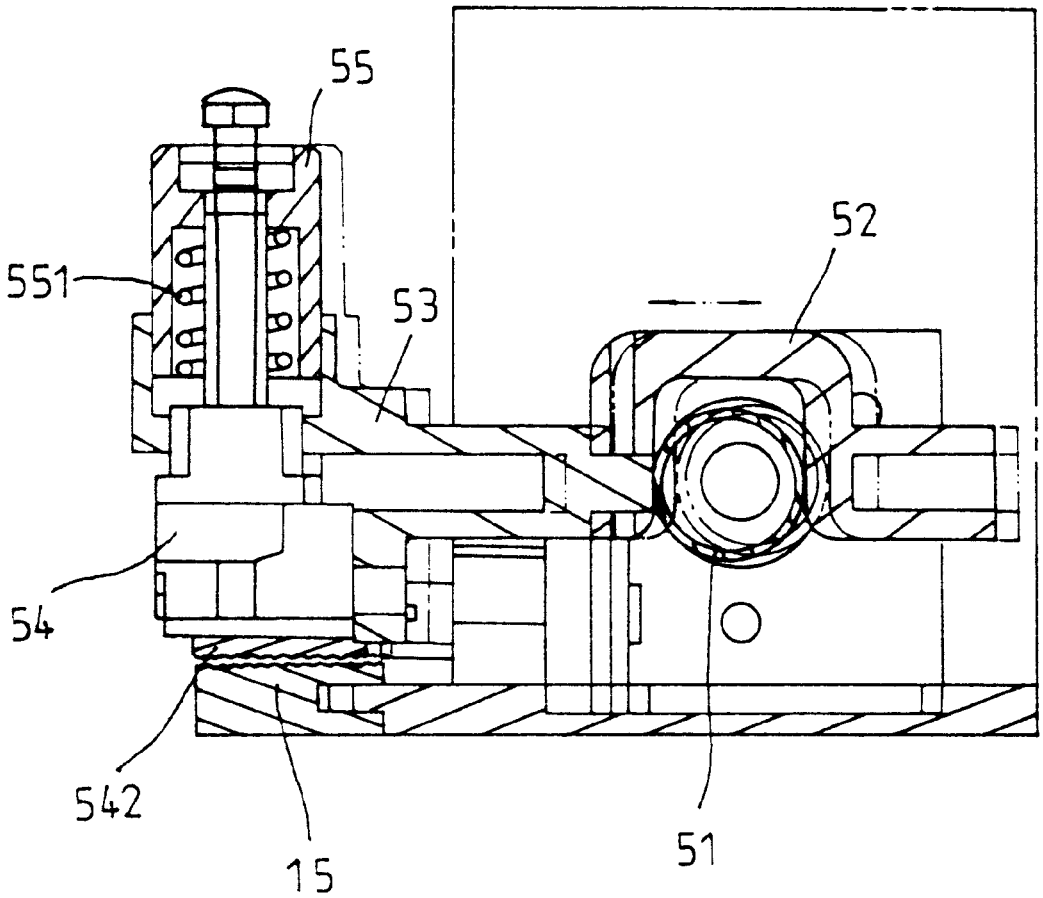

As can be seen from FIGS. 9 through 11, when the packaging tape (9) is tightened, the stress will gradually lift the tensioner (6) and so the upper oblique surface (631) of the push rod (63) starts to force the movable block (7) moving toward the U-shaped frame (56). When the movable block (7) separates its crooked end (72) from the lock plate (563) of the reversed U-shaped frame (56), the frame (56) is free to move. Under the influence of the back spring (564), the frame (56) inclines forwards as shown in FIGS. 11,12 so that the hooks (562) of the frame (56) are disengaged with the oblique surfaces (543) of the fusion block (54). As a result the fusion block (54) is free to drop as shown in FIG. 12 and the upper frictional plate (542) presses against the packaging tape (9). At the same time, the reversed U-shaped frame (56) approaches the contact switch (73) and actuates it. Then, the motor (2) stops first and so the tensioning mechanism stops as well. Then the motor (2) starts to rotate in a reversed direction to drive the unidirectional bearing (22) and the eccentric wheel (51). With the movement of the eccentric wheel (51) and the U-shaped connecting block (52), the stationary block (53) and the fusion block (54) shown in FIG. 13 will quickly travel to and fro along a transverse direction. Consequently, the upper frictional plate (542), under the influence of the spring (551), presses against the upper packaging tape (91) to rub the lower packaging tape (92) with a high speed until they are molten and joined. The adjustment wheel (55) can be rotated to adjust the pressure applied on the upper frictional plate (542) by the spring (551) to adapt for different requirements. In addition, the cutter (541) under the fusion block (54) can be adjusted by means of the spring (544) to make it suitable for cutting the upper packaging tape (91). When a preset time elapses the motor (2) will automatically stop. Users can lift the lever (12) and the lock plate (8) to sideways remove the apparatus from the package wrapped with the packaging tape (9). The oblique surface (33) of the transverse rod (3) pushes the raised block (561) of the reversed U-shaped frame (56) and makes the frame (56) return to the original vertical position. The hooks (562) of the frame (56) lift the fusion block (54) when the frame rotates and finally disengages the fusion block from the packaging tape. Furthermore, the guide pin (34) at the end of the transverse rod (3) pushes the lower oblique surface (632) of the push rod (63) to make the push rod (63) downwards and the movable block (7) returns to its original position by use of the spring (70). The invention makes use of an extension portion (16) situated on the side of the handle (11) to urge the movable block (7) forward by manual operation as shown in FIG. 9. When the wrapping tape reaches a point that the user considers the strain is enough, he or she may stop tension and start welding and cutting or manually weld and cut tape without the use of automatic tension control in this fashion.

The invention has an eccentric knob (17) as shown in FIG. 5, which is situated near the lower corner of the internal support plate (43) and used to control the gap between the support plate (43) and the lower frictional plate (15). When the surface (433) of the plate (43) touches the peripherary of the knob body that has a smaller radius the gap becomes smaller. Contrarily, when it touches the peripherary of the knob body that has a larger radius the gap becomes larger. In this fashion, the apparatue can be adapted for packaging tape with different thickness and the support plate and the lower frictional plate can be kept a safe distance away from each other when no tape is loaded.

From the above description, the invention uses a single motor, cooperated with two unidirectional bearings, to drive a tensioning mechanism and a sealing and cutting unit in a forward direction. It can effectively perform packaging operation and thus it has a practical value in this industry. Besides, after loaded with packaging tape, the apparatus uses a unidirectional bearing (41) to provide convenience that users can manually align packaging tape with the fusion block and properly strain it in advance so as to reduce the tensioning time, promoting efficiency. The tensioning mechanism uses a combination of a pinion, a worm, and a gear train so that it can reach a high speed reduction ratio and facilitate tensioning operation. The invention further uses cross-shaped axles as transmission means between frictional wheels and driving gears. Thus it can control the level of two frictional wheels and the evenness of the application of forces on packaging tape. During tensioning, the invention employs securing a lock edge (81) of locking plates (8) to a lock pin (122) of a lever (12) to keep the support plate (45) pressing against packaging tape. Therefore, the restoring forces caused by tensioning will not cause the packaging tape sliding out of places.

Figure 14:
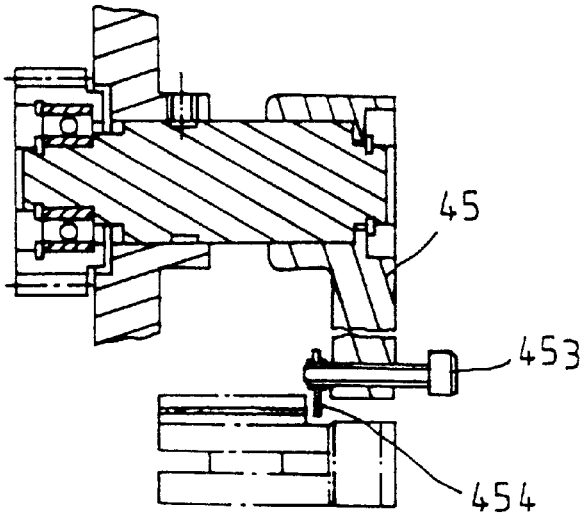
FIG. 14 shows a friction plate and the means adjusting the width of packing strip according to the invention.
Figure 15:
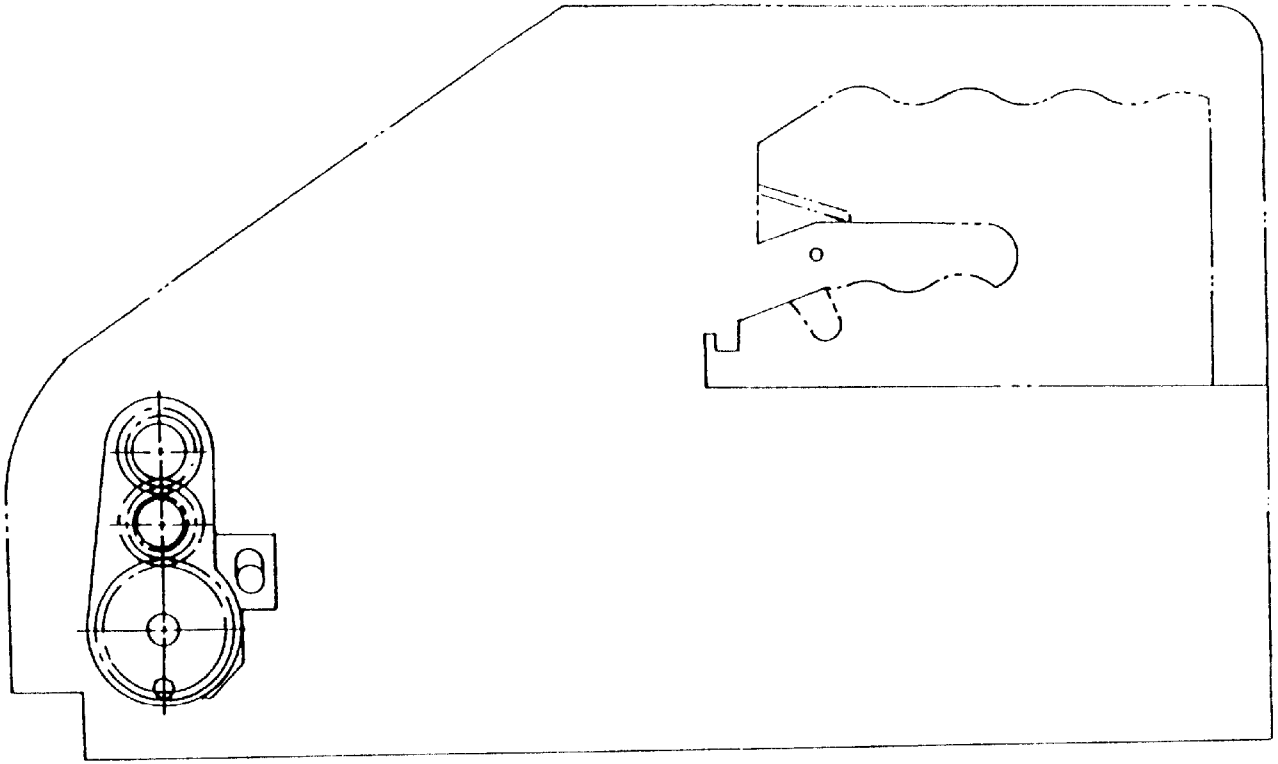
FIGS. 15–16 illustrates the practice of the invention.
Figure 16:
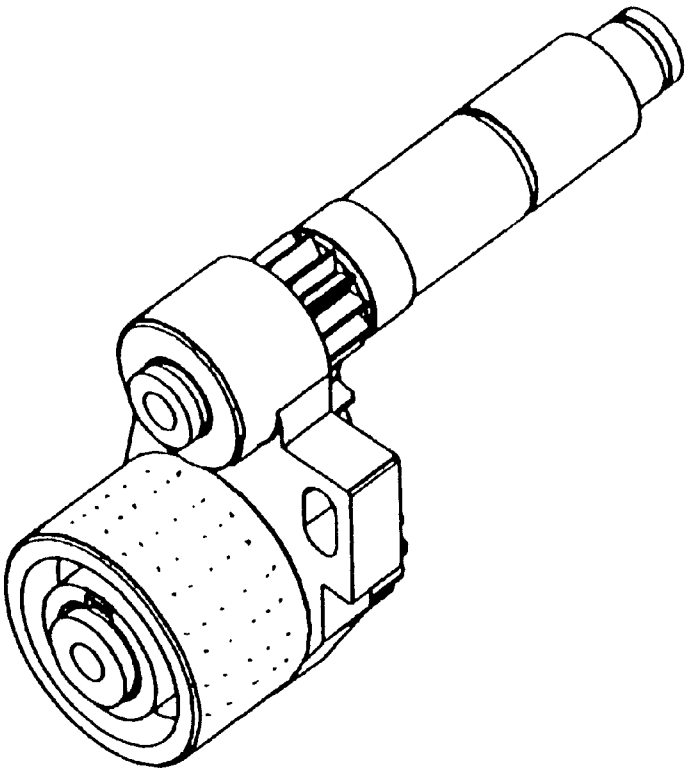

As shown in FIG. 14, disposed under the support plate (45) is a screw (453), to which a stop plate (454) seated inside the apparatus is connected. By means of the screw (453), the position of the stop plate (454) can be adjusted to fit for packaging tapes with different widths. The stop plate functions as a guide of tape during packing. Besides, inside the base (14) there are provided with replaceable locating blocks (18) among frictional plates (15). With the spring steel balls (181) on the locating blocks (18) in cooperation with the adjustment of the stop plate (454), the apparatus of the invention has enhanced effects of positioning and guiding packaging tape. The frictional plates and the cutter can be replaceable. Thus they can be replaced when worn out, extending the service life of the apparatus. Further, as shown in FIG. 10, the tensioner (6) contains an adjustment wheel (64), by which users can control the stiffness of the spring (65) and in turn change the strain value that packaging tape (9) will reach after tensioning. That means users can adjust the tensile forces applied by packaging tape on packages. Along with a column (671) on a block (67) under the adjustment wheel (64), an indicator (66) placed on the outside of the apparatus shows the tension, facilitating the adjustment of tensile forces. Moreover, the tensioning mechanism of the invention is a module in construction and thus it can be designed to have different reduction ratios for various speed reductions. FIGS. 15, 16 show a variation application example in which gears of the gear train is aligned in a single row. It is therefore to be understood that other modifications may be made in the construction of preferred forms of the present invention without departing from the spirit and scope as defined by the appended claims.

What is claimed is:

1. A portable electric wrapping apparatus, comprising:

a main body carrying a motor, the motor driving a main shaft inside the main body and respectively urging a tensioning mechanism and a sealing and cutting unit through two unidirectional bearings to gradually tighten packaging tape and at a preset tension to weld and cut the packaging tape automatically;

a handle and a lever extending from said main body;

a transverse rod disposed above said main body; and, a driven block being pivotably disposed inside said main body;

said lever being pivotably attached to said main body by a pin and having a hook at a lower end thereof to grasp a pole laterally extending from said transverse rod;

said driven block having an upper end mounted on the pole and a lower end equipped with a threaded hole;

a shaft of said motor extending into the main body to drive said main shaft, said main shaft having a pinion to drive a worm of a tensioning mechanism at a distal end thereof;

said tensioning mechanism having a transmission shaft connected through a unidirectional bearing to said worm to be driven in only one direction;

said transmission shaft being provided with a gear at a rear segment thereof and being connected to an internal support plate at a distal end thereof through a bearing;

said internal support plate having on one side surface thereof a protruding driving shaft extending into a hollow pole of an external support plate to support the external support plate, said external support plate having an elliptical hole, through which a threaded bolt passes to engage a threaded hole of a driving plate;

said transmission shaft gear being engaged to a gear train consisting of three gears, two of said three gears being disposed at lower positions and each having a cross-shaped axle projecting toward said external support plate;

said external support plate including two frictional wheels with a cross-shaped groove formed on a corresponding side thereof;

said grooves being dimensioned to receive said cross-shaped axle with a clearance fit;

a unidirectional bearing together with an eccentric wheel being mounted on a middle segment of the main shaft to drive said sealing and cutting unit in only one direction, and a U-shaped connecting block linked with a stationary block on one end thereof being disposed external to said eccentric wheel;

a fusion block being coupled to an adjustment wheel, said adjustment wheel being engaged to said stationary block by screw threads;

a cutter and an upper friction plate being inserted into a lower portion of said fusion block;

a reversed U-shaped frame being pivotably mounted on said main body;

two raised blocks being disposed on a top of said reversed U-shaped frame located near said transverse rod, said transverse rod having an oblique surface;

two hooks, configured to be caught by an inclined surface of said fusion block being respectively formed on two lower ends of said reversed U-shaped frame;

a tensioner disposed adjacent said sealing and cutting unit, said tensioner including a round column and a spring;

a top of said spring being connected to a push rod, said push rod having an upper and a lower oblique surface, said upper oblique surface being located in a central slot of a movable block and the lower oblique surface being situated below a guide pin at an end of said transverse rod;

said movable block having a crooked portion formed on an end thereof and abutting against a lock plate on said reversed U-shaped frame; and a contact switch being provided between said main body and said reversed U-shaped frame.

2. The portable electric wrapping apparatus as claimed in claim 1, further comprising a second lock plate pivotably attached to said handle and having a front portion with a locking edge and a lock groove; said locking edge being forced against a locking pin located on one side of said lever, wherein as said locking edge of said second lock plate slides and disengages from said locking pin, said lever starts to rise while said hook on said lever urges said transverse rod and said driving plate; said driving plate further moving said internal support plate around said transmission shaft and turning said external support plate by said driving shaft and said bearing for displacement to a certain angle to expose a space to receive packaging tape therein.

3. The portable electric wrapping apparatus as claimed in claim 1, further comprising a base disposed below said main body, said base having frictional plates disposed thereon at positions corresponding to said two frictional wheels and said upper frictional plate; each frictional plate having replaceable frictional surfaces on respective top and bottom sides thereof; a locating block with a spring steel ball being disposed between lower frictional plates for adapting said apparatus for different sizes of packaging tape.

4. The portable electric wrapping apparatus as claimed in claim 1, wherein said motor begins rotating said main shaft in a forward direction as said contact switch is depressed, said rotation of said main shaft rotating said pinion, said worm and said unidirectional bearing, said transmission shaft then being rotated and thereby rotating said gear train to rotate said two frictional wheels driven by said cross-shaped axles to move the packaging tape on the upper layer to gradually stretch the packaging tape to reach a tensioned state.

5. The portable electric wrapping apparatus as claimed in claim 1, further comprising an extension portion situated on a side of said handle for urging said movable block forward under a user's manual control, wherein the user can stop tensioning packaging tape and then start welding and cutting thereof.

6. The portable electric wrapping apparatus as claimed in claim 1, wherein an eccentric knob is situated near a lower corner of said internal support plate and used to control a gap between said support plate and a lower frictional plate for adapting said apparatus for use of packaging tape of different thicknesses and maintaining a safe distance between said support plate and said lower frictional plate when no tape is loaded.

7. The portable electric wrapping apparatus as claimed in claim 1, wherein a stop plate is seated against a screw inside said apparatus, said screw being adjusted to fit packaging tapes of different widths, said stop plate guiding tape during packing, said apparatus including a base having replaceable locating blocks and frictional plates, said locating blocks having spring steel balls that in combination with adjustment of said stop plate further enhance positioning and guiding of packaging tape.

8. The portable electric wrapping apparatus as claimed in claim 1, wherein said tensioner contains an adjustment wheel for a user's control of the strength of said spring and thereby preset a tension value the packaging tape will reach after tensioning, and along with a column on a block under the adjustment wheel, an indicator located on an outside of said apparatus shows the tension value to facilitate adjustment of tensile forces.

9. The portable electric wrapping apparatus as claimed in claim 1, further comprising locking plates having a lock edge secured by a lock pin of said lever to maintain said support plate pressing against packaging tape so that the restoring forces caused by tensioning will not cause the packaging tape to slide out of place.

10. A portable electric wrapping apparatus including a tensioning mechanism, and a sealing and cutting unit, each of which is designed as a module so that they can be made independently and then put together, facilitating assembling and manufacturing, said tensioning mechanism having gears aligned in a single row and a friction wheel coupled to a lowest gear of the gears to frictionally engage packaging tape and begin tensioning thereof.

* * * * *